United States Patent [19]

Bourguignon

[11] 4,197,618

[45] Apr. 15, 1980

[54] MAGNETIC CLOSURE DEVICE

[76] Inventor: Ludwig Bourguignon, Bernauerstrasse 75, 8210 Prien a. Ch., Fed. Rep. of Germany

[21] Appl. No.: 918,837

[22] Filed: Jun. 26, 1978

Related U.S. Application Data

[63] Continuation-in-part of Ser. No. 774,866, Mar. 7, 1977, abandoned, which is a continuation-in-part of Ser. No. 616,041, Sep. 23, 1975, abandoned.

[51] Int. Cl.[2] ..... A44B 21/00

[52] U.S. Cl. ..... 24/201 B

[58] Field of Search ..... 24/201 B; 403/DIG. 1

[56] References Cited

U.S. PATENT DOCUMENTS

| | | | |
|---|---|---|---|
| 2,389,298 | 11/1945 | Ellis | 24/201 B |
| 3,008,209 | 11/1961 | Kurt | 24/201 B |
| 3,102,314 | 9/1963 | Alderfer | 24/201 B |

*Primary Examiner*—Kenneth Dorner

*Attorney, Agent, or Firm*—W. G. Fasse; D. F. Gould

[57] ABSTRACT

The present magnetic closure device has one or more holding members and one or more closure members, each with a surface configuration providing an increased frictional force, when two matching surface configurations cooperate. One member of a pair forming a closure device is a permanent magnet of so-called hard magnetic material, while the other member of a pair is a magnetic armature made of ferromagnetically soft, magnetizable material. The increased frictional force and the magnetic force combine to provide an effective closure device for articles of non-magnetic material, such as leather goods, textiles, and synthetic materials. The two members have a square or rectangular configuration and are corrugated whereby both members have the same configuration and the permanent magnet has poles of one polarity extending along the entire length of a ridge in the corrugation, and poles of the opposite polarity extending along the entire length of the valleys adjacent to a ridge. This type of closure device has greatly improved holding characteristics.

7 Claims, 7 Drawing Figures

MAGNETIC CLOSURE DEVICE

CROSS-REFERENCE TO RELATED APPLICATIONS

The present application is a continuation-in-part application of my copending application Ser. No. 774,866, filed: Mar. 7, 1977, and now abandoned, which is a continuation-application of my application Ser. No. 616,041, filed: Sept. 23, 1975, now abandoned.

BACKGROUND OF THE INVENTION

The present invention relates to a magnetic closure device, especially for articles of non-magnetic materials, such as leather goods, textiles, synthetic materials, and so forth.

Closure devices of various kinds and useful for non-magnetic articles are known in large numbers. The so-called slide closure devices including various kinds of zippers are to be mentioned in this respect. Further, so-called rotary closure devices are also well known, whereby the latter are mainly used in connection with briefcases and the like.

Tension and pressure responsive closure means capable of taking up larger forces are also well known. Strapping closure devices belong in this group and are preferably used in connection with ski boots. In addition, there are buckle closure devices for belts and shoes. Especially the latter are well known in numerous embodiments.

Most of the known closure devices, especially the zipper type of closures require numerous individual parts which can be closed or opened only by applying more or less force resulting in a respective wear and tear. Another disadvantage of known closure devices is seen in their relatively limited adjustability. Thus, especially briefcase closure devices normally have only one closing position. Another disadvantage of prior art devices is seen in the substantial costs for the manufacturing of a large number of individual parts and assembling such parts, whereby the production of the individual parts also requires a substantial capital investment for machinery and tools. A further drawback of prior art devices is seen in the fact that they are prone to failure, since it is unavoidable that individual parts may break easily, because due to weight considerations such parts are of a rather light construction. Furthermore, especially those embodiments of the prior art which require a substantial number of links and levers and so forth are also prone to failure, because these links and levers may easily be damaged or bent or even broken.

German patent publication No. 1,760,095 discloses a shoe closure device especially for ski boots, which is provided with a magnetic safety catch. Such a safety catch comprises two interlocking closure members provided with permanent magnets having plane surfaces contacting each other. The pulling or tension forces tending to separate the closure members are taken up solely in a mechanical manner by the steep serrated flanks of the closure members. Practical experience has shown that this type of closure device results in an increased pressure, especially along the edges of the closure device and such pressure is transmitted to the foot or the ankle of the person wearing such boots. Another drawback is seen in that for closing the two closure members a substantial stretching of the boot uppers is necessary to a position extending even beyond the closure position, because the serrated flanks must be relatively large for this purpose. This stretching is especially required where the ski probe or rather its tip is used for the closing. Thus, the shoe uppers may easily be damaged by the ski pole tip and the serrated flanks of the closure members are subject to rapid wear.

U.S. Pat. No. 2,389,298 (Ellis) discloses a magnetic closure device wherein two serrated, permanent magnets are corrugated. Since the magnetic poles are located at the ends of the serrations there is room for improvement, especially since in Ellis the two permanent magnets begin to push away from one another when magnetic poles of equal polarity come to face each other.

OBJECTS OF THE INVENTION

In view of the above it is the aim of the present invention to achieve the following objects singly or in combination:

to provide an improved magnetic closure device as compared to the prior art described above and which may be manufactured at low costs and relatively little capital investment;

to provide a magnetic closure device of relatively low weight, wherein a permanent magnet and a magnetizable armature having the same configuration as the permanent magnet cooperate to achieve optimal closure forces;

to combine in a magnetic closure device the magnetic and mechanical features in such a manner that an extensive stretching during the closing itself is substantially reduced or altogether avoided;

to provide a magnetic closure device which is versatile and useful in many different applications to operate in the form of a zipper and even in the form of a button and/or snap button; and to provide a closure device which may be used for shoes, bags, belts, clothing, as well as for watch bands, safety belts, shoe and boot buckles including mountaineer boots and ski boots and many other applications, for example, briefcases and suitcases.

SUMMARY OF THE INVENTION

The above objects have been achieved according to the invention by a magnetic closure device comprising permanent magnet means and magnetizable armature means of ferromagnetically soft material. Both means are provided with profiled cooperating surfaces of such a shape that a quasi-magnetic translation is accomplished. Due to the combination of the magnetic holding force with the frictional forces, which are increased by the magnetic holding force and the magnetic instability force, a substantial closure force is accomplished which opposes any pulling or tension force tending to separate the two means. The surface area of one of the means may be relatively small as compared to the given surface area of the other means. The configurations of the surface areas have preferably contrary, but matching shapes such as corrugations whereby the ridges and valleys of the permanent magnet means have opposite magnetic polarities extending along the entire length of the respective ridge or valley.

It is a particular advantage of the closure device according to the invention that it obviates all, or substantially all mechanical elements which heretofore have been necessary to provide a straping or clamping action. Further, within the practical considerations, there are no limits in selecting the proper size of the present closure device for any particular requirements. The present closure device is rather variable in its adjustability and any number of adjustable steps may be provided for a substantially continuous adjustability. The permanent holding magnet is employed with an optimal efficiency and is not used as a safety latch against undesired opening, rather it forms part of the closure itself.

It is an essential further feature of the invention that due to the particular shape of the cooperating surface configurations, the pulling or tension force tending to separate the two surfaces extends perpendicularly to the resulting surface normal, whereby the optimal closure safety is assured. By using a corrugated armature and a corrugated permanent magnet with opposite magnetic polarities along the entire length of the ridges and valleys of the corrugations the magnetic closing forces are still substantially effective even if ridges of the permanent magnet face ridges of the soft magnetic material armature.

BRIEF FIGURE DESCRIPTION

In order that the invention may be clearly understood, it will now be described, by way of example, with reference to the accompanying drawings, wherein:

FIG. 1*a* illustrates a perspective view of a permanent magnet member according to the invention;

FIG. 1*b* illustrates an armature member according to the invention arranged for cooperation with the holding member of FIG. 1*a* and made of magnetizable, magnetically soft material;

Figure 4:
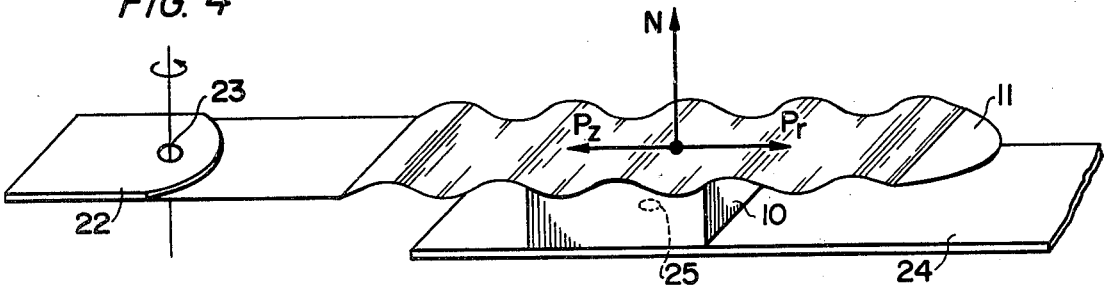
FIG. 4 illustrates a magnetic closure device according to the invention in its closed condition and with a pivoted permanent magnet member, as well as with a pivoted armature member.
Figure 5A:
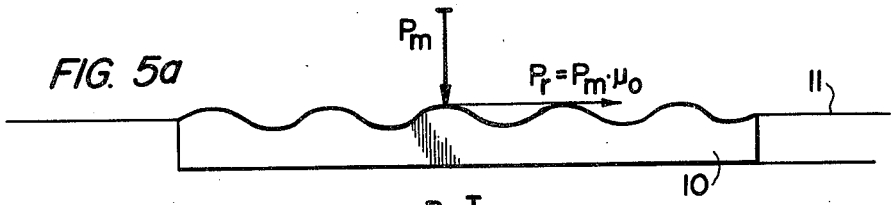
Figure 5B:
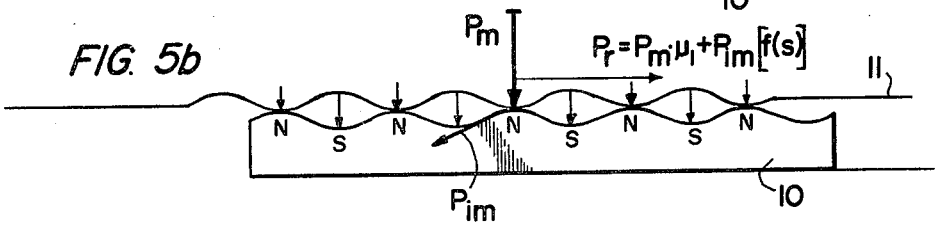

FIG. 5*a* illustrates in a somewhat schematic manner the direction of forces occurring in the closed condition of the closure device illustrated in FIG. 4; and FIG. 5*b* illustrates the direction of forces at a point of time when the opening of the device according to FIG. 4 has begun.

DETAILED DESCRIPTION OF PREFERRED EXAMPLE EMBODIMENTS

Figure 1B:
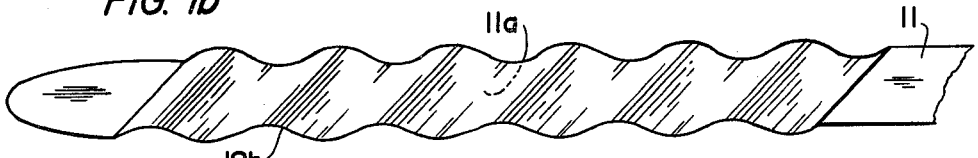
Figure 1A:
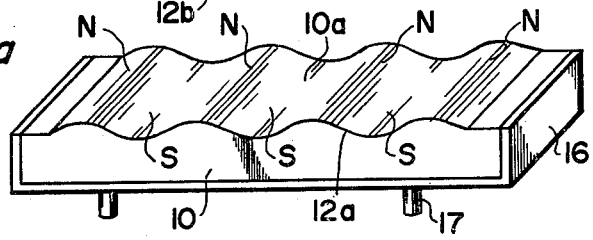

FIG. 1*a* illustrates a permanent magnet member or means 10 according to the invention, comprising a contact surface 10*a* having a wavy or corrugated surface configuration 12*a*. For example, the ridges of the corrugations have a north magnetic pole N extending along the entire length of each ridge and the valleys have a south magnetic pole S extending along the entire length of each valley. FIG. 1*b* illustrates an armature member or means 11 having a contact surface 11*a* with a surface configuration 12*b* shaped for hugging cooperation with the surface configuration 12*a* of the permanent magnet member 10. Preferably, the permanent magnet member 10 is made of a permanent magnetic material alloy comprising a rare earth metal, for example, samarium is suitable for the present purposes. Such permanent magnetic material alloys are well known in the art. The armature member 11 is made of a ferromagnetically soft and flexible material such as spring steel to form a strap as shown in FIG. 1*b*.

Preferably the permanent magnet member 10 and if desired also the armature member 11, are coated either entirely or partially with a coat 16 of a synthetic material, for example, of the polyvinylchloride type. Further, the member 10 or its coating 16 may be provided with locating studs or lugs 17 which assure, even if the member 10 is produced by mass production means, that the member 10 will always be properly located in the same position as determined by the locating studs 17. Thus, the member 10 will always be located at the same position, for example, on a shoe upper. The surface area of the member 10 may be only a fraction of the surface area of the flexible spring type armature member 11, since the latter is substantially longer than the permanent magnet member 10. This feature not only utilizes the permanent magnets most efficiently, it also assures a rather large adjustability range of the closure device. Another advantage of constructing the armature member 11 as a flexible spring is seen in that the tearing open moment at the member 10 as a result of a force applied perpendicularly thereto, is substantially eliminated, so that the magnetic closure device will tend to remain closed. Another advantage of the surface configuration shown in FIGS. 1*a* and 1*b* is seen in that the armature member 11 will automatically tend to match itself against the shape of the item to be closed, so that, for example, in connection with shoes no pressure or substantially no pressure will be applied to the feet of the wearer. This feature is due to the ridges N and valleys S of opposite magnetic polarity whereby the armature will be effective in any position relative to the permanent magnet.

Incidentally, all the magnet members will be designated by reference numeral 100, even if somewhat different surface configurations are illustrated. Similarly, all the armature members will be designated by the reference numeral 11, even if different surface configurations are involved.

Figure 2:
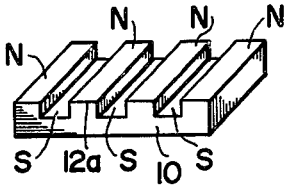
FIG. 2 illustrates a permanent magnet member with a tongue and groove surface configuration wherein the respective armature member of magnetically soft material would have the same surface configuration.

FIG. 2 illustrates another embodiment of a permanent magnet member 10 having a tongue and groove surface configuration. The respective closure member, which is not shown, will have the same surface configuration and would normally be longer than the length of the permanent magnet member 10 of FIG. 2. The ridges constitute north magnetic poles N and the valleys or groove bottoms constitute south magnetic poles S. However, the arrangement in this embodiment and any other embodiment could be vice versa with the south poles S along the ridges and the north poles N along the valleys.

Figure 3:
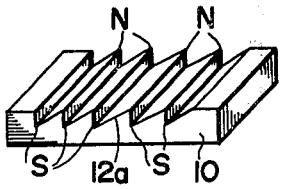
FIG. 3 illustrates a permanent magnet member with a serrated surface configuration, wherein the respective armature member of magnetically soft material would have the same serrated surface configuration.

FIG. 3 illustrates a still further embodiment of a permanent magnetic member 10 having a serrated surface configuration 12*a*, whereby the corresponding armature member would have the same serrated surface configuration and could be longer than the given length of the magnetic member, if desired. The frictional forces which combine with the magnetic forces are especially larger in the embodiments of FIGS. 2 and 3. Thus, these embodiments would be suitable for such purposes as belts, seat belts, and the like.

FIG. 4 illustrates in a somewhat schematic perspective view a closure device according to the invention in its closed condition, whereby the permanent magnet member 10 is pivoted by a pivot 25 to a substrate or strap 24. Similarly, the armature member 11 having a corrugated or wavy surface configuration is pivoted by means of a pivot 23 to a strap 22. The pivoting just described has the advantage that forces extending perpendicularly to the longitudinal extension of the closure device cannot be effective for creating moments tending to open the magnetic closure device. Another advantage of the pivoting is seen in the closure device is more easily adaptable to the contours of the article to be closed. FIG. 4 also shows the direction of the pulling force Pz and the direction of the frictional force. Both forces extend perpendicularly to the normal N' to the surface of the armature member 11.

FIGS. 5*a* and 5*b* are schematic illustrations of the embodiment of FIG. 4, whereby FIG. 5*a* shows the fully closed condition, whereas FIG. 5*b* illustrate a condition wherein the armature member 11 begins to open. In the normal, closed condition the magnetic force Pm substantially causes the friction force Pr due to the static friction coefficient $\mu 0$, whereby Pr corresponds to: $Pr = Pm \cdot \mu 0$. As the device begins to open, the static friction coefficient changes to a gliding friction coefficient $\mu 1$ and in addition the magnetic instability force Pim becomes effective due to the shifting of the two members 10 and 11 relative to each other along inclined surfaces. Such magnetic instability force tends to restore the original closed condition and is effective in the direction of the inclined surfaces as shown in FIG. 5*b*. At this instance the frictional force Pr becomes:

$$Pr = Pm \cdot \mu 1 + Pim\ [f(s)]$$

As a result this effect or rather this magnetic instability force contributes to the increase of the forces effective to tend to keep the device in the closed condition, such increase of the forces occurring in response to an attempt to open the device. This feature of the invention has the advantage that it increases the closing safety so that the closure device will automatically close itself again, if the frictional force is only exceeded momentarily and the applied momentary pulling force will contribute to the automatic closing.

In view of the foregoing disclosure, it will be appreciated that the present invention is suitable for closing many different items from garments, shoes and the like to briefcases, luggage and so forth.

Although the invention has been described with reference to specific example embodiments, it is to be understood, that it is intended to cover all modifications and equivalents within the scope of the appended claims.

What is claimed is:

1. A magnetic closure device comprising permanent magnet means and armature means of magnetizable, magnetically soft material, said magnet means and said armature means having the same configuration, both of said means having contrary but interfitting transversely extending surfaces with ridges and valleys extending along the entire width of the permanent magnet means and of the magnetizable armature means, said ridges and valleys matching each other, each of the permanent magnet means and said armature means having a length corresponding to at least two ridges and two valleys extending across said length to directly contact each other in any closed position of the closure device in the direction of said length, said ridges of said permanent magnet means having one magnetic polarity along their entire width extending across said length, and said valleys of said permanent magnet means having an opposite magnetic polarity relative to the ridges, said opposite magnetic polarity also extending along the entire width of the respective valley, whereby said armature means form two direct magnetic return paths for said permanent magnet means in any cooperating position of both means relative to each other along each of said at least two ridges and said at least two valleys, said ridges and valleys having a friction increasing shape so that the magnetic closing force is increased by the resulting friction force and by the magnetic instability force, and wherein said cooperating ridges and valleys have such a shape that any pulling force tending to separate said magnet means and said armature means extends substantially perpendicularly to a surface which extends normal to said cooperating valleys and ridges, whereby an increased combined holding force is realized by any cooperating position of said first and second means relative to each other.

2. The closure device of claim 1, wherein said armature means comprise a corrugated strap of flexible spring material, and wherein said magnet means comprise a correspondingly corrugated permanent magnet.

3. The closure device of claim 1, wherein said ridges and valleys substantially eliminate air gaps in said direct magnetic return path.

4. The closure device of claim 1, wherein said permanent magnet means and said armature means comprise attachment means.

5. The closure device of claim 1, further comprising separate support elements for said permanent magnet means and for said armature means and means pivoting said magnet means and said armature means to its respective support element.

6. The closure device of claim 1, wherein said permanent magnet means are made of a material which is of the rare earth metal alloy type.

7. The closure device of claim 6, wherein said rare earth metal alloy comprises samarium.

* * * * *

UNITED STATES PATENT OFFICE

CERTIFICATE OF CORRECTION

Patent No. 4,197,618 Dated April 15, 1980

Inventor(s) Ludwig Bourguignon

It is certified that error appears in the above-identified patent and that said Letters Patent are hereby corrected as shown below:

Claim 1, column 6, line 18, before "two" insert --at least--;

Claim 1, column 6, line 30, replace "by" by --in--.

Signed and Sealed this

Tenth Day of June 1980

[SEAL]

Attest:

SIDNEY A. DIAMOND

Attesting Officer

Commissioner of Patents and Trademarks